US006752208B1

(12) United States Patent
Nguyen

(10) Patent No.: US 6,752,208 B1
(45) Date of Patent: Jun. 22, 2004

(54) METHODS OF REDUCING PROPPANT FLOWBACK

(75) Inventor: Philip D. Nguyen, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 2 days.

(21) Appl. No.: 10/339,035

(22) Filed: Jan. 8, 2003

(51) Int. Cl.[7] ..... E21B 43/267

(52) U.S. Cl. ..... 166/280.1; 166/283; 166/303; 166/278; 166/308.1; 507/270; 507/271; 507/924

(58) Field of Search ..... 166/308.1, 280.1, 166/283, 303, 278, 280.2, 281; 507/924, 269, 270, 271

(56) References Cited

U.S. PATENT DOCUMENTS 5,908,073 A * 6/1999 Nguyen et al. ..... 166/276
6,053,992 A 4/2000 Wu et al.
6,436,120 B1 8/2002 Meglin
6,438,303 B1 8/2002 Abbott, III et al.

* cited by examiner

*Primary Examiner*—David Bagnell
*Assistant Examiner*—G M Collins
(74) *Attorney, Agent, or Firm*—Robert A. Kent; Mitch Lukin

(57) ABSTRACT

Methods of reducing proppant flowback during production of fluids form subterranean formations are provided. Compressed sieves made from a shape memory material are introduced into hydraulic fracturing opera into hydraulic fractures in subterranean formations during hydraulic fracturing operations or subsequent thereto. The heat of the formation, or introduced heat, triggers the return of the sieves to their previous uncompressed shape and size. The sieves thereby wedge themselves into position within the fractures and serve to filter proppant and formation fines from produced fluids.

11 Claims, 1 Drawing Sheet

METHODS OF REDUCING PROPPANT FLOWBACK

BACKGROUND OF THE INVENTION

1. Field of the Invention

The present invention relates generally to improved methods of reducing proppant flowback and the production of formation fines in fluids produced from subterranean formations, and more particularly, to introducing shape memory sieves into hydraulic fractures in the subterranean formation to strain proppant and formation fines from produced fluids.

2. Description of the Prior Art

The entrainment of particulate matter in fluids produced from subterranean formations is a significant problem. Entrained particulate matter may precipitate, causing problems like clogging small orifices in valves and other devices, and eroding pipeline components. The erosion problem is particularly severe in high-pressure, high-flow rate situations, for example, where producing natural gas or oil.

Some of this problematic particulate matter is formation fines, but another significant source can be solid particulate material introduced into the well during hydraulic fracturing treatments. Hydraulic fracturing techniques, intended to enhance production by forming and propping open fractures in subterranean zones, are well known to those skilled in the art. Typical hydraulic fracturing processes involve pumping at high pressure a viscous fracturing fluid through the wellbore and into the subterranean formation, thereby creating fractures in the formation. These fractures are intended to allow the desired fluids in the formation to flow more readily into the wellbore. When the pressure of the fracturing fluid is relieved, the fractures will tend to close. Thus, fracturing fluids usually contain suspended solid particulate material, intended to be deposited within the fractures to prop the fractures open once the pressure of the fracturing fluid is relieved. This suspended solid particulate material is referred to in the art as "proppant." Proppant may be sand or ceramic beads of suitable mesh size. Once the fracturing fluid has created fractures in the formation and flowed into those fractures, the proppant is precipitated out of the fluid by reducing the viscosity of the fluid using techniques known in the art. The deposited proppant prevents the fractures from completely closing when the pressure of the fracturing fluid is relieved.

The distribution of the proppant in the fractures creates a permeable medium through which the desired fluids will flow from the formation to the wellbore. Commonly, this distribution is uneven, resulting in channels of varying size in the proppant bed, and in a quantity of the proppant not being trapped in the fractures. If the channels in the trapped proppant bed are of sufficient size, the fluids flowing through the channels will entrain loose proppant and carry it to the wellbore. This undesirable occurrence is referred to as "proppant flowback." Proppant flowback can cause problems like clogging and eroding of pipeline components.

Many methods are known in the art for reducing proppant flowback and the production of formation fines. For instance, gravel packs and screens may be placed at the entrance to the wellbore. While gravel packs may prevent the production of particulate matter with formation fluids, they often fail and require replacement due to, inter alia, the deterioration of the perforated or slotted liner or screen as a result of corrosion or the like. Additionally, gravel packs are expensive to install, and the removal and replacement of a failed gravel pack is even more expensive.

Methods for retaining proppant within the fractures to prevent flowback also are known. For example, proppant material can be coated with curable resins that cause the proppant to agglomerate and consolidate within the fractures, thus reducing the amount of flow-back. However, these resins are expensive and may not withstand the effect of stress cycling during production and shut-in of the well. Other known methods such as mixing fibers or deformable particulate matter with the proppant also are not satisfactory.

Thus, there is a continuing need for improved methods of reducing proppant flowback and production of formation fines when producing fluids from subterranean formations that will overcome the limitations of known methods.

SUMMARY OF THE INVENTION

The present invention provides improved methods for reducing proppant flowback and the production of formation fines from hydraulic fractures in subterranean formations. More particularly, the present invention involves introducing compressed shape memory sieves into the fractures and then inducing the compressed sieves to return to their original shape, thereby forming permeable barriers within the fractures that prevent proppant and formation fines from being entrained in the produced fluids.

In one embodiment of the present invention, compressed sieves made from a shape memory material are carried into hydraulic fractures by the fracturing fluid during hydraulic fracturing operations. When the heat of the surrounding formation raises the temperature of the sieves sufficiently, the sieves substantially return to their pre-compression size and configuration. The sieves thereby wedge themselves into place within the fracture and filter fluids flowing from the formation to the wellbore.

In another embodiment of the present invention, compressed sieves made from a shape memory material are introduced into hydraulic fractures subsequent to the hydraulic fracturing operation. This requires injecting a fluid carrying the sieves through existing well casing perforations, preferably using pinpoint injection techniques.

Other and further objects, features, and advantages of the present invention will be readily apparent to those skilled in the art upon a reading of the description of preferred embodiments that follow.

DESCRIPTION OF PREFERRED EMBODIMENTS

Figure 1:
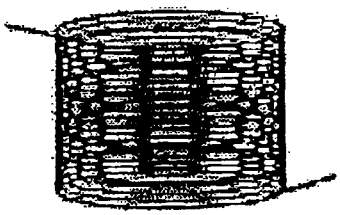
FIG. 1 is a depiction of a spool of Nitinol wire from which an embodiment of the invention can be constructed.

The present invention provides improved methods for filtering proppant and formation fines from fluids produced from subterranean formations. In various embodiments of the present invention, compressed sieves constructed from shape memory materials are introduced into hydraulic fractures through which the produced fluids will flow. After introduction into the fractures, the compressed sieves are induced to return substantially to their pre-compression size, causing them to lodge within the fractures. As the produced fluids flow from the formation, the sieves filter particulate matter such as proppant and formation fines from the fluids.

Most preferably, the sieves of the present invention are made from materials known as shape memory materials. A useful characteristic of shape memory materials is their ability, once mechanically deformed from an original shape, to spontaneously return to their original shape on the application of an external stimulus such as heat. Types of shape memory materials include both shape memory metal alloys ("SMMA") and shape memory polymers. In preferred embodiments of the present invention, SMMAs are used, but those skilled in the art, with the benefit of this disclosure, will recognize instances where shape memory polymers may be also advantageously employed. Examples of suitable SMMAs often comprise nickel-titanium alloys ("Nitinol") and may further comprise other elements to achieve desired properties. Once deformed, SMMAs usually can be induced to return substantially to their original shape by a thermal or stress trigger. In preferred embodiments of the present invention, thermally triggered alloys rather than stress-triggered alloys are used, but stress-triggered alloys also may be suitable.

Small changes in the Nitinol alloy composition can result in wide changes in the triggering temperature. Nitinol alloys usually are comprised of about 55% by weight of nickel, the balance being titanium. A Nitinol alloy comprising less than 55% by weight of nickel will usually have a triggering temperature above 95° C. As the weight percentage of nickel approaches 56%, the triggering temperature drops, approaching 0° C. Preferably, the alloy selected for the sieves should have a triggering temperature greater than that the sieves will be exposed to prior to their introduction into a subterranean formation, but lower than that of the subterranean formation into which the sieves are introduced.

In one example of a preferred embodiment of the present invention, sieves are constructed from SMMA wire formed in a geometric configuration. Preferably, this geometric configuration is a parabolic configuration. Those skilled in the art can readily envisage other configurations that may be advantageously employed. In any selected configuration, the overall size of the sieve and the mesh size of the openings in the sieve depend on the application, considering the size of the voids required to be filled and the size of the expected particulate matter. Generally, sieves with diameters of about 2 mm to about 8 mm are suitable. Smaller or larger sieves may be appropriate for particular applications. Mesh openings of about 0.05 mm to about I mm are suitable, however, smaller or larger mesh sizes may be appropriate for particular applications.

In another preferred embodiment of the present invention, the sieves optionally may be coated with corrosion inhibitors or curable resins to improve corrosion resistance to optimize performance of the sieves.

Figure 2:
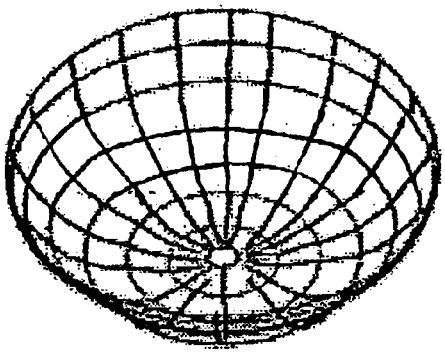
FIG. 2 is a view of one embodiment of a parabolic sieve constructed from Nitinol wire, with the Nitinol in its martensite phase.
Figure 5:
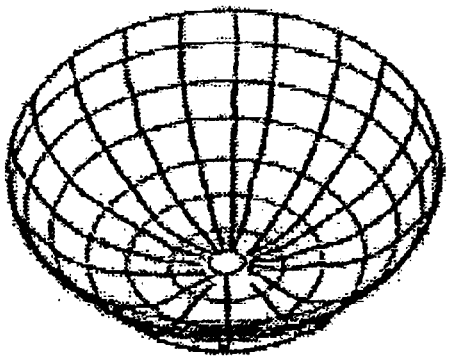
FIG. 5 is a depiction of one embodiment of the parabolic sieve having completed its transformation into its original shape.
Figure 4:
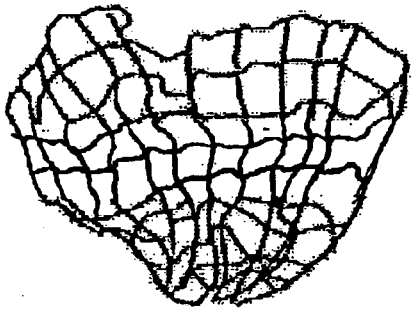
FIG. 4 is a depiction of one embodiment of the parabolic sieve returning to its original shape as the Nitinol undergoes transformation into its austenite phase.
Figure 3:
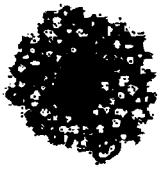
FIG. 3 is a depiction of one embodiment of the parabolic sieve being compressed into a more compact shape.

In the preferred embodiment of the present invention depicted in the referenced drawings, the parabolic sieve is constructed from Nitinol wire (FIG. 1) using techniques known in the art, Examples of fabrication techniques suitable for Nitinol sieves are described in U.S. Pat. Nos. 6,438,303 and 6,436,120. At the time of fabrication, the Nitinol is in a twinned martensite phase. The completed sieve (FIG. 2) is then compressed into a more compact shape (FIG. 3) by folding or molding it using conventional techniques known in the art. As a result, the Nitinol transforms (FIG. 4) into a de-twinned martensite phase. The sieve will retain this compressed shape until a phase-change trigger such as one described above is applied. For example, the application of sufficient heat will transform the Nitinol into its austenite phase; this phase transformation "unlocks" the strain in the de-twinned martensite phase, allowing the crystalline structure to return to its unstrained configuration (FIG. 5). The physical shape of the sieve when the Nitinol is in its austenite phase is identical to its previous shape in the twinned martensite phase. If the sieve is then cooled, the Nitinol will return to the twinned martensite phase with its physical shape unchanged. During the phase change from de-twinned martensite to austenite, the Nitinol is capable of producing large stress, which is thought to enhance the ability of the sieves to beneficially wedge themselves into place.

In another preferred embodiment of the present invention, the sieves of the present invention are compressed and then mixed with proppant material in a hydraulic fracturing fluid. Preferably, the sieves are constructed such that their compressed diameter and density will approximate that of the proppant material. The ratio of sieve material to proppant material is selected based on the application, with sieve material comprising from about 0% to about 50%, and preferably from about 0.1% to about 3% by weight of the mixture. The proppant/sieve mixture is then conveyed into subterranean fractures during hydraulic fracturing using conventional hydraulic fracturing fluids and techniques. Preferably, the latent heat of the formation will be sufficient to trigger the return of the sieves to their uncompressed shape, but heat can also be introduced during the fracturing operation using conventional steam injection techniques. The introduction of fracturing fluids into a wellbore normally cools the wellbore and surrounding formation significantly, allowing the sieves to flow into the created fractures before expansion of the sieves occurs. Once the triggering temperature is achieved, the sieves will attempt to expand to their original size and configuration. As a result, the edges and surfaces of the sieves will engage with the formation or proppant material, thereby wedging themselves within the fracture. The sieves have the additional desirable quality of deforming in conformance with subsequent changes in the fracture size, ensuring that the sieves remain wedged in the fracture.

In a further preferred embodiment of the present invention, the sieves of the present invention can be introduced using conventional well servicing techniques into existing subterranean fractures resulting from a previous fracturing treatment. In this embodiment of the present invention, the sieves are suspended in a viscosified carrier fluid, and a pinpoint injecting device is used to inject the fluid carrying the sieves through existing perforations in the wellbore piping and into the previously created fractures wherein the sieves are deposited. This procedure may be repeated in stages to ensure that the fluid carrying the sieves enters all of the fractures in the zone being treated.

Thus, the present invention is well adapted to carry out the objects and attain the ends and advantages mentioned as well as those that are inherent therein. While numerous changes can be made by those skilled in the art, such changes are encompassed within the spirit of this invention as defined by the appended claims.

What is claimed is:

1. A method for reducing the production of formation fines and proppant during production of fluid from a well having a hydraulic fracture comprising:

a) supplying a fracturing fluid comprising compressed shape memory sieves to a hydraulic fracture in a subterranean formation, b) allowing the compressed shape memory sieves to decompress within the hydraulic fracture, and c) producing fluid through the hydraulic fracture with reduced production of formation fines and proppant.

2. The method of claim 1 wherein the fracturing fluid is supplied through perforations in an existing well casing using pinpoint injection techniques.

3. The method of claim 1 wherein the fracturing fluid further comprises proppant material.

4. The method of claim 1 wherein the compressed shape memory sieves comprise an alloy of nickel and titanium.

5. The method of claim 1 wherein the compressed shape memory sieves comprise a corrosion-inhibiting coating.

6. A method for reducing the production of formation fines and proppant during production of fluid from a well having a hydraulic fracture comprising:

a) supplying a fracturing fluid comprising compressed shape memory sieves to a hydraulic fracture in a subterranean formation, b) supplying a heated fluid to the hydraulic fracture to induce the compressed shape memory sieves to decompress within the hydraulic fracture, and c) producing fluid through the hydraulic fracture with reduced production of formation fines and proppant.

7. The method of claim 6 wherein the fracturing fluid and the heated fluid are supplied through perforations in an existing well casing using pinpoint injection techniques.

8. The method of claim 6 wherein the fracturing fluid further comprises proppant material.

9. The method of claim 6 wherein the compressed shape memory sieves comprise an alloy of nickel and titanium.

10. The method of claim 6 wherein the compressed shape memory sieves comprise a corrosion-inhibiting coating.

11. The method of claim 6 wherein the heated fluid is steam.

* * * * *